US005964282A

United States Patent [19]

Seiler et al.

[11] Patent Number: 5,964,282

[45] Date of Patent: Oct. 12, 1999

[54] STEPPED DIMPLED MOUNTING BRACKETS FOR HEAT EXCHANGERS

[75] Inventors: Thomas F. Seiler, Milton; Peter Zurawel; Dan Constantin Stefanoiu, both of Mississauga; Brian Alwyn Anthony, Kleinburg, all of Canada

[73] Assignee: Long Manufacturing Ltd., Oakville, Canada

[21] Appl. No.: 09/105,978

[22] Filed: Jun. 26, 1998

[30] Foreign Application Priority Data

Sep. 11, 1997 [CA] Canada ..... 2215173

[51] Int. Cl.[6] ..... F28D 1/02

[52] U.S. Cl. ..... 165/153; 165/152; 165/140; 165/175; 165/170

[58] Field of Search ..... 165/153, 152, 165/140, 175, 170

[56] References Cited

U.S. PATENT DOCUMENTS

| | | | |
|---|---|---|---|
| 4,081,025 | 3/1978 | Donaldson | 165/140 |
| 4,258,785 | 3/1981 | Beldam . | |
| 4,274,482 | 6/1981 | Sonoda . | |
| 4,815,532 | 3/1989 | Sasaki et al. | 165/152 |
| 4,854,380 | 8/1989 | Yoshida et al. | 165/152 |
| 4,932,469 | 6/1990 | Beatenbough | 165/153 |
| 5,036,911 | 8/1991 | So et al. | 165/153 |
| 5,180,004 | 1/1993 | Nguyen | 165/140 |
| 5,184,673 | 2/1993 | Hedman et al. | 165/153 |
| 5,325,915 | 7/1994 | Fouts et al. . | |
| 5,413,169 | 5/1995 | Frazier et al. | 165/153 |
| 5,632,331 | 5/1997 | Shinmura | 165/153 |
| 5,634,519 | 6/1997 | Laveran | 165/153 |
| 5,667,007 | 9/1997 | Nishishita | 165/153 |
| 5,810,077 | 9/1998 | Nakamura et al. | 165/153 |

FOREIGN PATENT DOCUMENTS

| | | |
|---|---|---|
| 0 563 474 | 10/1993 | European Pat. Off. . |
| 2 077 678 | 11/1971 | France . |
| WO 93/11399 | 6/1993 | WIPO . |

OTHER PUBLICATIONS

Patent Abstracts of Japan, vol. 097, No. 012, Dec. 12, 1997 & JP 09 217992 A (Denso Corp), Aug. 19, 1997.

*Primary Examiner*—Ira S. Lazarus
*Assistant Examiner*—Terrell McKinnon
*Attorney, Agent, or Firm*—Barrigar & Moss

[57] ABSTRACT

A mounting or end bracket is disclosed for producing plate and fin heat exchangers of the type having a plurality of stacked, hollow plate pairs or tubes including mating end bosses having communicating openings formed therein to form a manifold for the flow of fluid through the plate pairs or tubes. Fins are located between and at the top end bottom of the stacked plate pairs or tubes extending between the end bosses. End fittings are used for the inlet and outlet of fluid to the plate pairs or tubes. The mounting brackets allow the end fittings to be positioned where desired to define different flow circuits through the plate pairs, and also allow different size end fittings to be used, without having to use special spacers, different size fins or specially shaped plates to accommodate the different end fittings. The mounting brackets have a planar central portion and opposed offset end portions located in a plane parallel to and spaced from the central portion. The central portion has spacing projections extending transversely in a direction opposite to that of the opposite end portions. Different fitting sizes are accommodated simply by changing the height of the spacing projections.

20 Claims, 4 Drawing Sheets

STEPPED DIMPLED MOUNTING BRACKETS FOR HEAT EXCHANGERS

FIELD OF THE INVENTION

This invention relates to plate or tube and fin heat exchangers of the type having a plurality of stacked plate pairs or tubes with cooling fins located therebetween, and in particular, to devices for changing the flow path or circuits inside the plate pairs or tubes.

BACKGROUND OF THE ART

Heat exchangers have been produced in the past which are made up of a plurality of stacked, hollow plate pairs or tubes for the flow of one fluid therethrough. The plate pairs or tubes often have raised end bosses located at opposed ends to space the plate pairs or tubes apart and form common flow manifolds for feeding fluid through the plate pairs or tubes. The thus spaced-apart plate pairs or tubes allow for the transverse flow of another fluid, such as air, between the plate pairs or tubes, and cooling fins are often located in the spaces between the plate pairs or tubes to enhance the heat transfer co-efficient of the heat exchanger.

Sometimes, it is desirable to provide inlet and outlet fittings located in these manifolds between the plate pairs or tubes to force the fluid to flow along a predetermined path or circuit using a preselected combination or order of flow amongst the plate pairs or tubes. It is also desirable sometimes to divide the stack of plate pairs or tubes into separate modules, each having its own inlet and outlet, so that there is, in effect multiple heat exchangers or modules in one unitary structure.

One way of accomplishing these desired results in the past has been to use spacers and perhaps special or unique plates or tubes for some of the plate pairs or tubes where the end bosses in the special plates or tubes are of reduced height or possibly eliminated altogether to accommodate the inlet or outlet fittings. Another way is to use special, extra high fins, or double or triple layers of fins, between some of the plate pairs or tubes to make room for the inlet or outlet fittings between the plate or tube end bosses where the inlet or outlet fittings are to be placed. A difficulty with these methods, however, is that several unique or odd-shaped components are necessary which make it difficult to assemble the heat exchangers and result in many errors being made by positioning the wrong components in the wrong locations. The result is many defective or inoperative heat exchangers being produced.

The present invention minimizes the number of different types of components that must be used to produce a heat exchanger, yet easily accommodates different flow circuit configurations and sizes of inlet and outlet fittings by using a common mounting or end bracket dimensioned to accommodate a particular size of inlet or outlet fitting yet allowing for fins of the same fin height to be used.

SUMMARY OF THE INVENTION

According to one aspect of the invention, there is provided a mounting bracket for producing a plate or tube type heat exchanger. The mounting bracket comprises an elongate, generally flat plate having a planar central portion and opposed, offset end portions located in a plane parallel to and spaced from the central portion. The central portion has spacing projections extending transversely in a direction opposite to that of the offset end portions. The offset end portions extend a first predetermined distance from the planar central portion, and the spacing projections extend a second predetermined distance from the planar central portion.

According to another aspect of the invention, there is provided a plate or tube and fin heat exchanger comprising a module including a plurality of stacked, hollow plate pairs or tubes including mating end bosses having communicating openings formed therein to form a manifold for the flow of fluid through the plate pairs or tubes. A top fin is located on top of the stacked plate pairs or tubes. A bottom fin is located below the stacked plate pairs or tubes. At least one intermediate fin is located between the plate pairs or tubes. The fins all extend between the respective end bosses. Top and bottom mounting brackets are provided each having a planar central portion in contact with the respective top and bottom fins and opposed offset end portions located in a plane parallel to and spaced from the central portion and in contact with an adjacent end boss of an adjacent plate pair or tube. The offset end portions extend a first predetermined distance from the planar central portion. The central portion further has spacing projections extending transversely in a direction opposite to that of the offset end portions. The projections extend a second predetermined distance from the planar central portion. One of the offset end portions has an inlet orifice communicating with one of the end boss openings, and another of the offset end portions has an outlet orifice communicating with another of the end boss openings.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
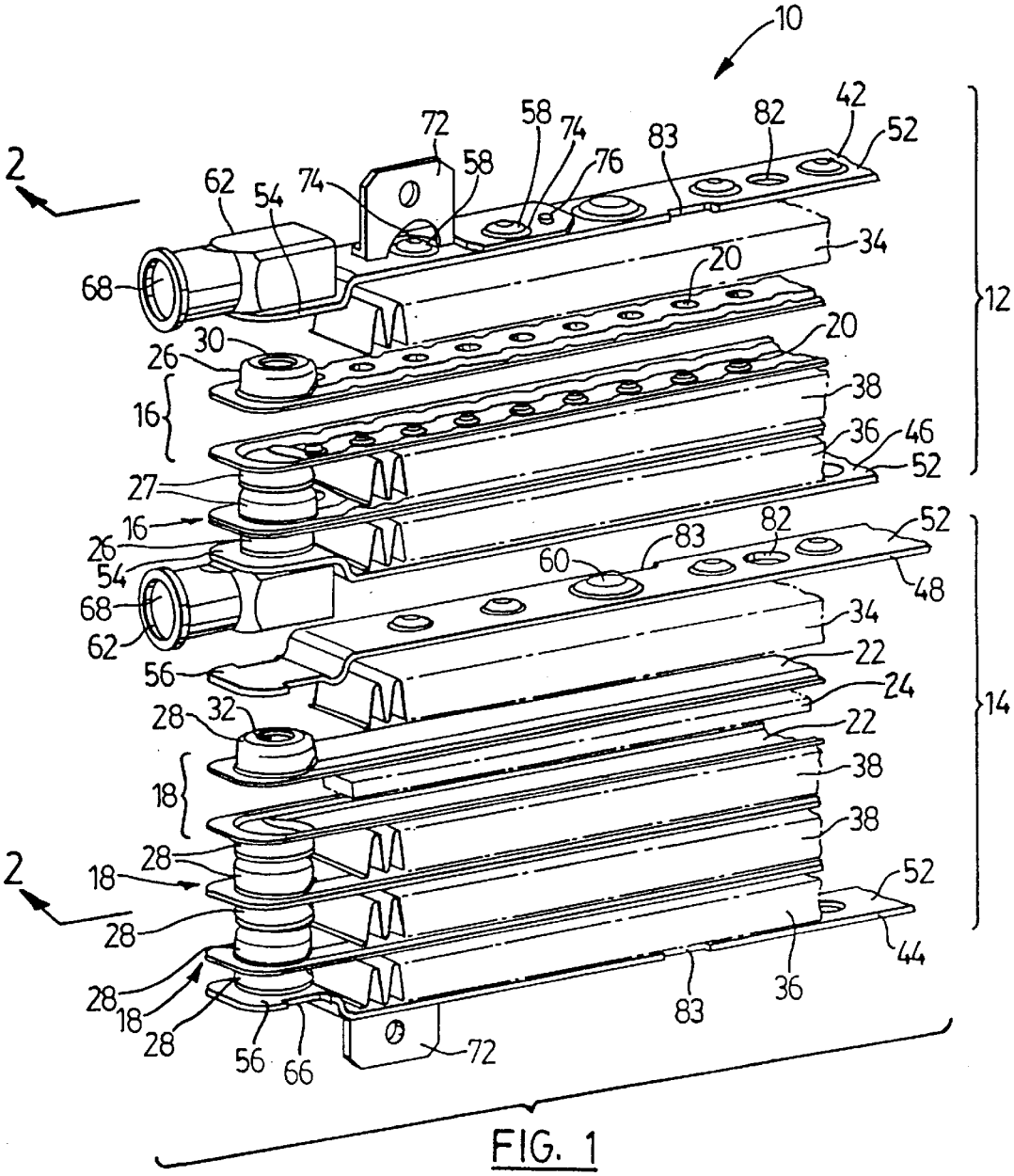
FIG. 1 is an exploded perspective view of a portion of a preferred embodiment of a heat exchanger according to the present invention.
Figure 2:
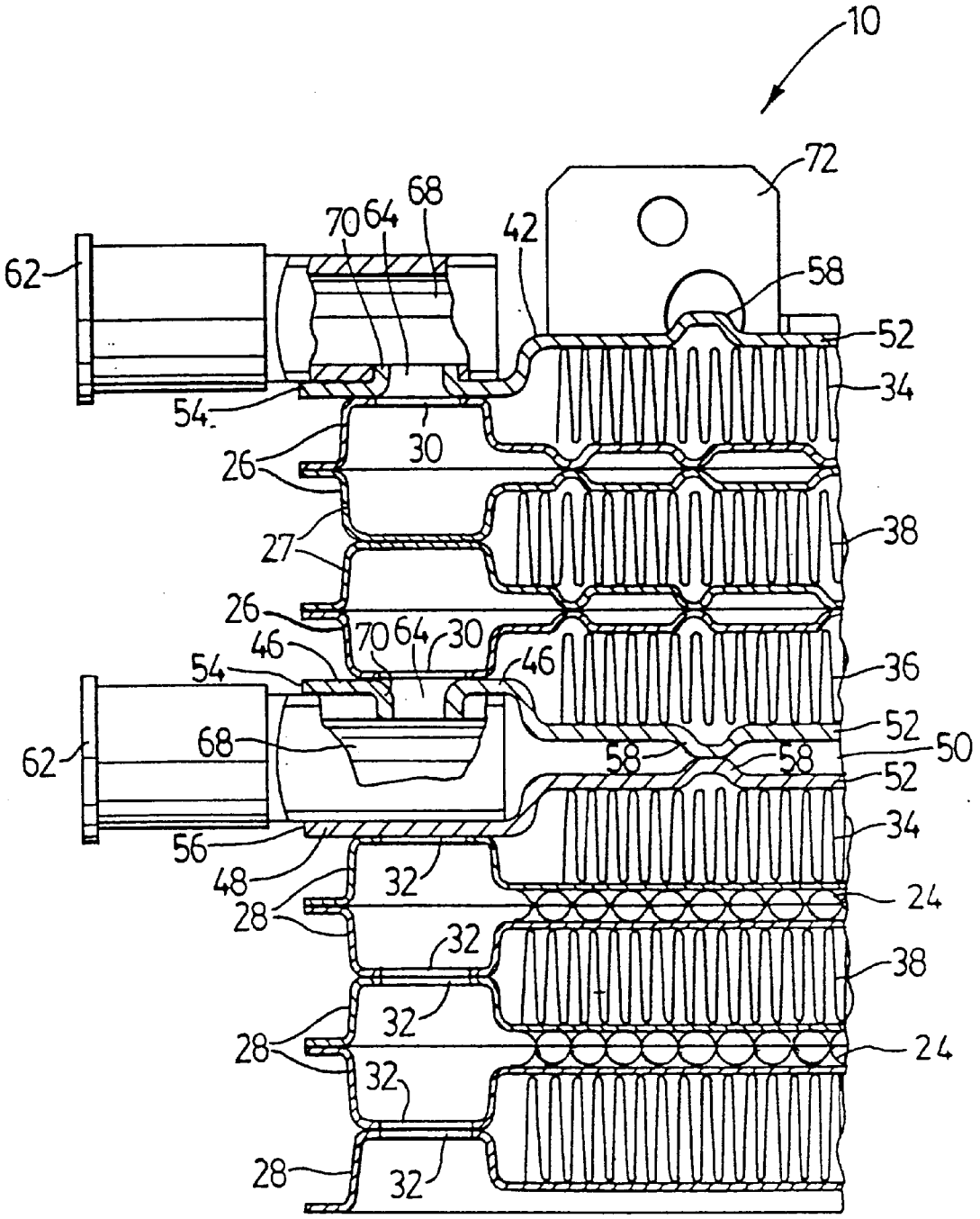
FIG. 2 is an elevational view, partly broken away, of the upper left corner of the heat exchanger of FIG. 1 taken in the direction of arrows 2—2.
Figure 6:
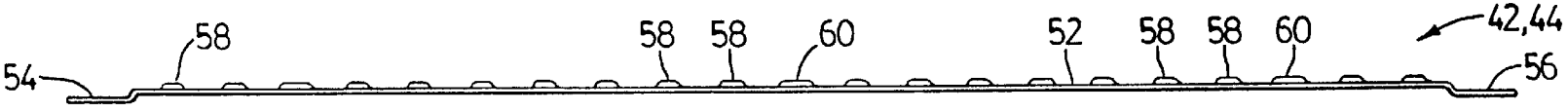
FIG. 6 is a front or elevational view of the mounting bracket shown in FIG. 3.
Figure 5:
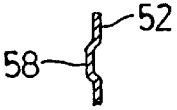
FIG. 5 is a sectional view taken along lines 5—5 of FIG. 3.
Figure 4:
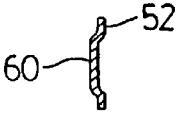
FIG. 4 is a sectional view taken along lines 4—4 of FIG. 3.

Referring firstly to FIGS. 1 and 2, a preferred embodiment of a plate and fin heat exchanger according to the present invention is generally indicated by reference numeral 10.

Heat exchanger 10 includes two modules 12 and 14, each containing a separate flow circuit for accommodating a different fluid. For example, module 12 could be used to cool automotive transmission oil or fluid, and module 14 could be used to cool automotive engine oil. It will be appreciated, however, that heat exchanger 10 could be used to heat different fluids as well. Also, although two modules 12, 14 are shown, any number of modules could be incorporated into a single heat exchanger 10.

Heat exchanger 10 is formed of a plurality of stacked, hollow plate pairs 16, 18 although tubes could be used in place of the plate pairs. For the purposes of this disclosure, plate pairs are considered to be equivalent to tubes. Other flow conduits could be used as well, and collectively, all of these plate pairs, tubes or other conduits may sometimes be referred to as flow channels. Plate pairs 16 are formed of mating plates that have inwardly joined dimples 20 and are thus called dimpled plate pairs 16. Plate pairs 18 are formed of plates that have flat centre sections 22 and expanded metal turbulizers 24 are located inside the plate pairs. Plate pairs 18 are thus called flat plate pairs. Each of the plate pairs 16, 18 has mating end bosses 26, 28. These end bosses have communicating openings 30, 32 to form an aligned flow manifold for the flow of fluid through the plate pairs. Some of the end bosses, such as end bosses 27 may not have openings therein, or these openings may be closed in other ways to provide a particular flow circuit inside the modules, as will be described further below.

Heat exchanger 10 includes a top fin 34 located on top of the stacked plate pairs 16, and a bottom fin 36 located below the stacked plate pairs 18. Module 12 also has a bottom fin 36 and module 14 has a top fin 34. Intermediate fins 38 are located between the plate pairs. All of the fins 34, 36 and 38 extend between their respective end bosses 26, 27 and 28 located at the opposed ends of the plate pairs.

Plate pairs 16, 18, or the tube equivalents, and fins 34, 36 and 38, are not considered to be part of the present invention, per se. Any type of plate or tube and any type of fins, either dimpled or of the flat turbulizer type, can be used in heat exchanger 10. It is part of the present invention, however, that the fins 34, 36 and 38 all be generally of the same height, and the end bosses 26, 27 and 28 all be generally of the same height. In other words, there is no need in heat exchanger 10 to use special fins or fins of different heights, or to use plate pairs or tubes where some of the plates or tubes have end bosses of different heights.

Module 12 has a top mounting or end bracket 42, and module 14 has a bottom mounting or end bracket 44. Mounting brackets 42, 44 are shown separately in FIGS. 3 to 6.

Module 12 also has a bottom mounting bracket 46 and module 14 has a top mounting bracket 48. Actually, all of the mounting brackets 42, 44, 46 and 48 are identical. Mounting brackets 46 and 48, however, are preferably formed into a subassembly 50 shown by itself in FIGS. 7 to 11 and described further below. Although brackets 42, 44, 46 and 48 are referred to as mounting brackets, they could also be called end brackets, because they need not be used for mounting either heat exchanger 10 or other components to heat exchanger 10. For the purposes of this disclosure, the terms "mounting" and "end" in relation to brackets 42, 44, 46 and 48 are used interchangeably.

Referring next in particular to FIGS. 3 to 6, mounting or end brackets 42, 44 have a planar central portion 52 and opposed offset end portions 54, 56 located in a plane parallel to and spaced from central portion 52. As seen best in FIG. 2, planar central portions 52 of top and bottom mounting brackets 42, 46 are in contact with respective top and bottom fins 34, 36. Similarly, for module 14, planar central portions 52 of top and bottom mounting brackets 48, 44 are in contact with respective top and bottom fins 34, 36 for this module. Offset end portions 54, 56 are in contact with an adjacent end boss 26 or 28 as the case may be. Offset end portions 54, 56 extend a first predetermined distance from planar central portion 52. This predetermined distance is equal to one-half the fin height of fins 34, 36 and 38.

Planar central portions 52 also have spacing projections in the form of dimples 58, 60 extending transversely in a direction opposite to that of offset end portions 54, 56. Projections or dimples 58, 60 extend a second predetermined distance from planar central portion 52. That second predetermined distance is such that where two mounting or end brackets are located back-to-back as is the case with subassembly 50, the distance between the adjacent offset end portions at each end of the mounting brackets is equal to the height of end fittings 62 located therebetween. For the purposes of this disclosure, this fitting height is referred to as a third predetermined distance.

Figure 3:
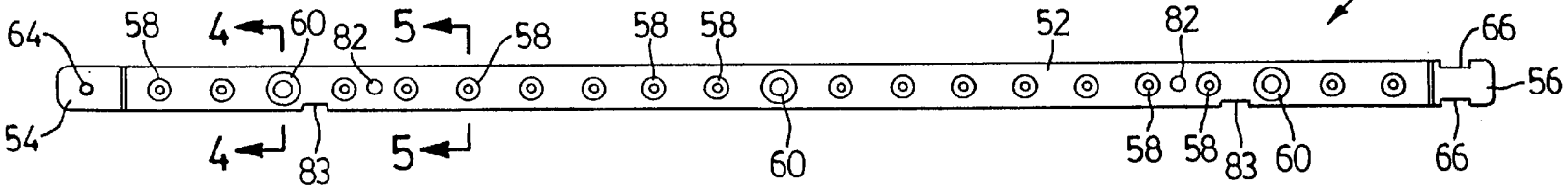
FIG. 3 is a plan view of a mounting or end bracket used in the heat exchanger of FIG. 1.
Figure 11:
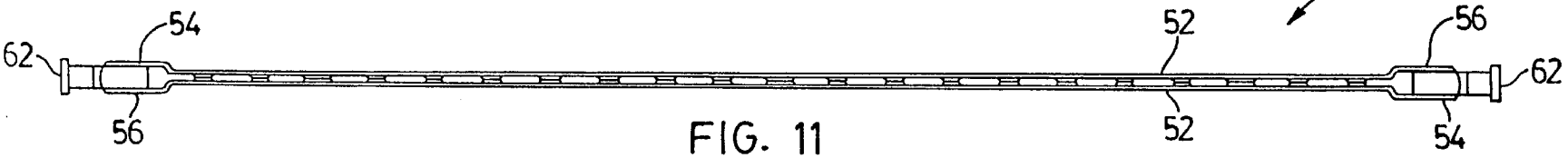
FIG. 11 is a front or elevational view of the sub-assembly of FIG. 7.
Figure 10:
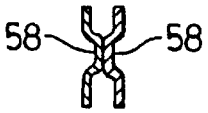
FIG. 10 is a sectional view taken along lines 10—10 of FIG. 7.

As seen best in FIG. 3, one of the offset end portions 54 of mounting brackets 42, 44 is formed with a flow orifice 64, and the other offset end portion 56 is blank or closed. Offset end portions 56 are formed with peripheral notches 66 for error proofing the assembly of heat exchanger 10 and for indicating the fluid flow circuit inside the heat exchanger, as will be described further below. It will be appreciated also that peripheral notches 66 could be provided on offset end portions 54 instead of offset end portions 56 to accomplish the same results.

Referring again to FIGS. 1 and 2, end fittings 62 include internal flow passages 68 that communicate with flow orifices 64 in offset end portions 54. Actually, end fittings 62 have transverse openings which are aligned with flow orifices 64, and a staking operation is used to attach end fitting 62 to offset end portions 54 as indicated by the formed flanges 70 in FIG. 2.

As seen also in FIGS. 1 and 2, heat exchanger 10 includes attaching or attachment brackets for mounting the heat exchanger in a desired location. Attachment brackets 72 can be any configuration desired, but they preferably have circular or semi-circular openings 74 for accommodating dimples 58 to help align attachment brackets 72 during the assembly of heat exchanger 10. Attachment brackets 72 are temporarily attached to mounting brackets 52, 54 by rivets 76, or by a type of swaging or staking operation referred to by the trademark TOGGLE LOCK, as will be described further below. If desired, suitable attachment brackets can also be located between mounting or end brackets 42, 44 in subassembly 50. This arrangement is particularly useful where it is desired to mount other components in front of or behind heat exchanger 10.

Figure 9:
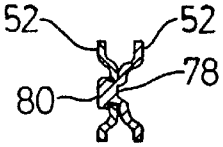
FIG. 9 is a sectional view taken along lines 9—9 of FIG. 7.
Figure 8:
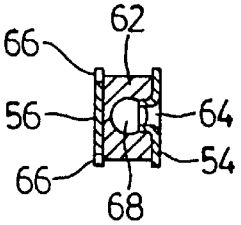
FIG. 8 is a sectional view taken along lines 8—8 of FIG. 7.
Figure 7:
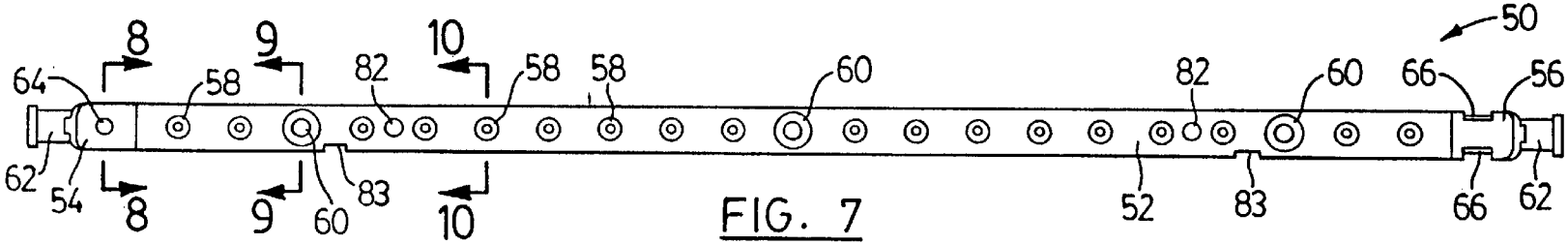
FIG. 7 is a plan view of a mounting bracket sub-assembly as used in the heat exchanger of FIG. 1.

Referring next to FIGS. 7 to 11, it will be noted that dimples 60 are of larger diameter than dimples 58. The reason for this is to facilitate the attachment of central portions 52 to form subassembly 50. Referring to FIG. 9, this is done using a punch and die set marketed in association with the trademark TOGGLE LOCK. It is a clinching operation where a punch pushes metals from both parts through to an expanding die that forms a button on the underside of the parts to hold them together. This is like a self-forming rivet, and as seen in FIG. 9, the punch leaves a depression 78 on one side of the joined parts and a button 80 on the other side of the parts. The larger dimples 60 provide a little extra material for this operation to prevent the punch from breaking through the material. However, rivets or spot welding could be used to join the mounting brackets instead of the TOGGLE LOCK fastening device, if desired.

Mounting or end brackets 42, 44, 46 and 48 are also formed with alignment holes 82 and peripheral notches 83 to help align the components during the assembly or subassembly process.

Figure 12:
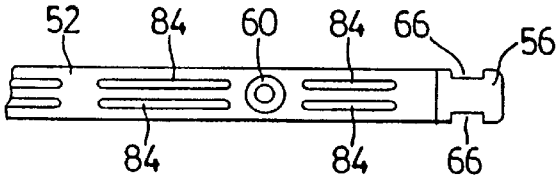
FIG. 12 is a plan view of a portion of another embodiment of a mounting bracket according to the present invention.

Referring next to FIG. 12, it will be seen that instead of dimples 58, 60, the spacing projections can be in the form of elongate ribs 84. Preferably, ribs 84 are rib segments to permit air to flow between the planar central portions 52 of subassembly 50, but the ribs could be full length, if desired. Also, the ribs could be transversely obliquely orientated rather than longitudinally orientated.

In the assembly of heat exchanger 10, the desired flow circuits or passes are first determined. For example, in module 12 in the heat exchanger shown in FIG. 1, it is desired that fluid enter one of the end fittings 62, pass through an inlet flow orifice 64 in one of the offset end portions and into one of the end boss openings 30. The fluid then flows the length of one of the plate pairs 16. The flow is reversed at the opposite end of the plate pairs and comes back to exit through outlet orifices communicating with the other end fittings 62. Either end fitting 62 can be used as a flow inlet fitting; the other end fitting 62 being the flow outlet fitting. In module 14 the end fittings 62 are located to the right (not shown). Fluid flow passes through one end fitting 62 in a similar manner to travel along one or more of the plate pairs 18. The flow is then reversed, because the end bosses 28 form a manifold, and the fluid flows back to exit through the other end fitting 62.

Having decided upon a desired flow circuit for heat exchanger 10, the desired number of plate pairs 18 and fins 34, 36 and 38 are stacked on top of bottom mounting bracket 44, after having staked an end fitting 62 to the offset end portion 54 of mounting bracket 44. A subassembly 50 is then mounted on top of the top fin 34. A desired number of plate pairs 16 are then stacked on top of subassembly 50, and top mounting bracket 52 is located on top of top fin 34 of module 12, again after having staked an end fitting 62 to the offset end portion 54 of top mounting bracket 42. The assembly is then permanently joined by brazing or soldering to complete the heat exchanger.

It will be appreciated by those skilled in the art that by swapping the mounting brackets end for end and turning end fittings 62 upside down, that any flow configuration or circuit can be provided in heat exchanger 10. Instead of multiple passes through the plate pairs 16, 18, full flood modules can be made where the fluid flows in the same direction through all of the plate pairs in one or both of the modules.

Although subassembly 50 is shown in FIGS. 7 to 11 having a flow orifice offset end portion 54 located adjacent to a closed offset end portion 56, one of the mounting brackets can be turned end for end. In this case, the adjacent flow orifice offset end portions 54 could have an end fitting 62 with a transverse hole that passes right through the fitting to communicate with both orifices 64 allowing flow to go into or out of two adjacent modules simultaneously.

It will also be appreciated that by using multiple subassemblies 50, a heat exchanger 10 can be made having any number of additional modules. Further, end fittings 62 can be orientated in other directions, such as transverse to the plate pairs.

It will also be appreciated that if it is desired to use an end fitting 62 of a different height, this can simply be accommodated by changing the height of dimples 58, 60, so that the spacing between the adjacent offset end portions 54, 56 matches the height of the desired end fitting therebetween. Identical mounting brackets can still be used throughout heat exchanger 10, because the height of the dimples in the top and bottom mounting brackets 42, 44 does not matter. As mentioned above, the fin heights do not have to change either, because the offset end portions ensure that the same fin heights can be used with different fitting heights.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A mounting bracket for a heat exchanger, the mounting bracket comprising:

an elongate, generally flat plate having a planar central portion and opposed offset end portions located in a plane parallel to and spaced from the central portion; the central portion having spacing projections extending transversely in a direction opposite to that of the offset end portions, the offset end portions extending a first predetermined distance from the planar central portion; and the spacing projections extending a second predetermined distance from the planar central portion.

2. A mounting bracket as claimed in claim 1 wherein the first predetermined distance is such that where the mounting bracket is used in a plate and fin or tube heat exchanger with the fins between the offset end portions, the first predetermined distance is equal to one-half the height of the fins.

3. A mounting bracket as claimed in claim 1 wherein the second predetermined distance is such that where two mounting brackets are located back-to-back, the distance between the offset end portions of the back-to-back mounting brackets is equal to a third predetermined distance.

4. A mounting bracket as claimed in claim 1 wherein one of said offset end portions is formed with a flow orifice and the other offset end portion is blank.

5. A mounting bracket as claimed in claim 1 wherein said spacing projections are in the form of dimples.

6. A mounting bracket as claimed in claim 1 wherein said spacing projections are in the form of elongate ribs.

7. A mounting bracket as claimed in claim 1 wherein said spacing projections are in the form of elongate rib segments.

8. A mounting bracket as claimed in claim 4 wherein one of the offset end portions is formed with peripheral notches to distinguish the two offset end portions.

9. A mounting bracket as claimed in claim 5 wherein said spacing projection dimples are of different diameters.

10. A heat exchanger comprising: a module including a plurality of stacked, hollow plate pairs or tubes including mating end bosses having communicating openings formed therein to form a manifold for the flow of fluid through the plate pairs or tubes; a top fin located on top of the stacked plate pairs or tubes; a bottom fin located below the stacked plate pairs or tubes; at least one intermediate fin located between the plate pairs or tubes; said fins all extending between the respective end bosses; top and bottom mounting brackets each having a planar central portion in contact with respective top and bottom fins and opposed offset end portions located in a plane parallel to and spaced from the central portion and in contact with an adjacent end boss of an adjacent plate pair or tube, the offset end portions extending a first predetermined distance from the planar central portion; the central portion further having spacing projections extending transversely in a direction opposite to that of the offset end portions, said projections extending a second predetermined distance from the planar central portion; one of said offset end portions having an inlet orifice communicating with one of the end boss openings; and another of the offset end portions having an outlet orifice communicating with another of the end boss openings.

11. A heat exchanger as claimed in claim 10 wherein said first predetermined distance is equal to one-half the fin height.

12. A heat exchanger as claimed in claim 10 and further comprising an end fitting attached to said one offset end portion and having a flow passage communicating with said inlet orifice.

13. A heat exchanger as claimed in claim 12 and further comprising a second end fitting attached to said other offset end portion and having a flow passage communicating with said outlet orifice.

14. A heat exchanger as claimed in claim 12 and further comprising a third mounting bracket mounted back-to-back with one of the top and bottom mounting brackets said second predetermined distance being such that the distance between the offset end portions of said one and said third mounting brackets is equal to the height of the end fitting located therebetween.

15. A heat exchanger as claimed in claim 10 wherein said module is a first module, and further comprising one or more additional modules, a top mounting bracket of one module being joined back-to-back with a bottom mounting bracket of an additional module.

16. A heat exchanger as claimed in claim 15 and further comprising an end fitting located between adjacent offset end portions of the back-to-back mounting brackets, the second predetermined distance being such that the distance between said offset end portions is equal to the height of the end fitting located therebetween.

17. A heat exchanger as claimed in claim 16 wherein the end fitting includes a flow passage communicating with at least one of the inlet and outlet orifices in the offset end portions.

18. A heat exchanger as claimed in claim 15 wherein said first predetermined distance is equal to one-half the fin height.

19. A heat exchanger as claimed in claim 17 and further comprising a plurality of additional like end fittings, one of said additional end fittings being attached to each of the other offset end portions having inlet and outlet orifices.

20. A mounting bracket as claimed in claim 15 wherein said spacing projections are in the form of dimples.

* * * * *